US005099703A

United States Patent [19]

Isozumi

[11] Patent Number: 5,099,703

[45] Date of Patent: Mar. 31, 1992

[54] INERTIA DRIVE ENGINE STARTER

[75] Inventor: Shuzoo Isozumi, Hyogo, Japan

[73] Assignee: Mitsubishi Denki K.K., Tokyo, Japan

[21] Appl. No.: 476,227

[22] Filed: Feb. 7, 1990

[30] Foreign Application Priority Data

Feb. 17, 1989 [JP] Japan ..... 1-18009[U]

[51] Int. Cl.[5] ..... F02N 11/10

[52] U.S. Cl. ..... 74/6; 74/7 R; 29/48

[58] Field of Search ..... 74/6, 7 R; 123/179 M; 290/38 B, 48

[56] References Cited

U.S. PATENT DOCUMENTS

| | | | |
|---|---|---|---|
| 1,493,892 | 5/1924 | Munz | 74/7 R |
| 1,748,902 | 2/1930 | Royce | 123/179 M |
| 1,764,906 | 6/1930 | Steiner | 74/7 R |
| 3,686,961 | 8/1972 | Campbell | 74/7 R |
| 4,779,470 | 10/1988 | Morita et al. | 74/7 R |

FOREIGN PATENT DOCUMENTS

| | | | |
|---|---|---|---|
| 424426 | 1/1926 | Fed. Rep. of Germany | 74/7 R |
| 466282 | 10/1928 | Fed. Rep. of Germany | 74/7 R |
| 846641 | 8/1952 | Fed. Rep. of Germany | 74/6 |
| 2339195 | 2/1975 | Fed. Rep. of Germany | 123/179 M |
| 129013 | 8/1950 | Sweden | 123/179 M |
| 128285 | 10/1928 | Switzerland | 74/7 R |

*Primary Examiner*—Leslie A. Braun
*Assistant Examiner*—Scott Anchell
*Attorney, Agent, or Firm*—Sughrue, Mion, Zinn, Macpeak & Seas

[57] ABSTRACT

An inertia drive engine starter comprising an electric motor having an armature shaft provided with an axial, bottomed central bore in the front end, a slide output shaft provided with a pinion at the front end thereof and a stopper at the rear end thereof received in the bottomed central bore of the armature shaft, and an overrunning clutch for transmitting the torque of the armature shaft to the slide output shaft. Internal helical splines formed in the inner surface of the inner race of the overrunning clutch and external helical splines formed in the outer surface of the slide output shaft are engaged to transmit the torque of the armature shaft to the slide output shaft and to thrust the slide output shaft to the front when the electric motor is actuated. The axial movement of the slide output shaft is limited to a predetermined fully advanced position by the engagement of the stopper provided at the rear end of the slide output shaft with the inner race of the overrunning clutch, which is restrained from axial movement.

6 Claims, 2 Drawing Sheets

INERTIA DRIVE ENGINE STARTER

BACKGROUND OF THE INVENTION

1. Field of the Invention

The present invention relates to an inertia drive engine starter and, more specifically, to an inertia drive engine starter having a slide output shaft provided with helical splines, and a splined sleeve provided with splines engaging the splines of the slide output shaft to shift the slide output shaft axially by the torque of the slide output shaft when the slide output shaft is rotated.

2. Description of the Prior Art

An inertia drive engine starter of such a type is disclosed in Japanese Patent Provisional Publication No. 56-107957. As shown in FIG. 2, this known inertia drive engine starter (hereinafter, referred to simply as "engine starter") is provided with an overrunning clutch 4 and a pinion 5, which are mounted axially slidably on the outer portion 3 of the armature shaft 2 of an electric motor 1. Internal helical splines formed in the inner surface of the boss of the outer race 4*a* of the overrunning clutch 4 are in mesh with helical splines 6 formed in the outer portion 3 of the armature shaft 2. The pinion 5 is formed integrally with the inner race 4*b* of the overrunning clutch 4. The inner race 4*b* and the pinion 5 are fastened to a sleeve bearing 7 axially slidably put on the armature shaft 2 in the outer portion 3. The armature shaft 2 is supported at its extremity in a bearing 14 fitted in a front end plate 15. Also shown in FIG. 2 are the ring gear 8 of the engine, a stopper 9 fixed to the extremity of the outer portion 3 of the armature shaft 2, a return spring 10 mounted between the pinion 5 and the stopper 9 on the outer portion 3, and a feed terminal M through which power is supplied to the electric motor 1.

Referring to FIG. 3, in operation, the starter switch 11 of the vehicle is closed to supply current from a battery 12 to the switch coil 13*a* of an electromagnetic switch, and then the plunger 13*b* of the electromagnetic switch 13 is attracted to bring a moving contact into contact with stationary contacts 13*d* and 13*e*, so that a normally open contact consisting of stationary contacts 13*d* and 13*e* is closed. Consequently, the battery 12 supplies current through the feed terminal M of the electric motor 1 to the field coil 1*a* and the coil of the armature 1*b* of the electric motor 1 to rotate the armature 1*b*. Then, the overrunning clutch 4 and the pinion 5 combined with the overrunning clutch 4 are caused to slide to the front (to the right as viewed in FIG. 2) against the resilience of the return spring 10 by the agency of the thrust of the helical splines 6 of the outer end portion 3 acting on the helical splines of the inner race 4*b* of the overrunning clutch 4 and the inertia of the overrunning clutch 4, so that the pinion 5 and the ring gear 8 are engaged to start the engine. When the starter switch 11 is opened, the moving contact 13*c* is separated from the stationary contacts 13*d* and 13*e* by a return spring, not shown, to stop supplying current to the electric motor 1, so that the pinion 5 is returned together with the overrunning clutch 4 to its initial position as shown in FIG. 2 by the return spring 10.

The extremity of the outer end portion 3 of the armature shaft 2 of the known inertia drive engine starter thus constructed extends to the front beyond the pinion 5, and the stopper 9 is fixed to the extremity of the outer end portion 3. Therefore, it is very difficult to mount the inertia drive engine starter on the engine because the extermity of the outer end portion 3 and the stopper 9 interfere with the ring gear 8 and, in some cases, the ring gear 8 is damaged by the extremity of the outer end portion 3 of the armature shaft 2 and/or the stopper 9. Furthermore, the extremity of the outer end portion extending beyond the pinion 5 and the stopper 9 attached to the extremity of the outer end portion 3 requires a space for receiving the same, which places restrictions on the design of the engine. Accordingly, improvement has been desired to solve those problems in the conventional inertia drive engine starter.

SUMMARY OF THE INVENTION

Accordingly, it is an object of the present invention to provide an inertia drive engine starter having no component disposed outside a pinion which engages the ring gear of an engine, and having no component which is possible to interfere with the engine in mounting the inertia drive engine starter on the engine.

To achieve the object of the invention, the present invention provides an inertia drive engine starter comprising an electric motor having an armature provided with an armature shaft, an overrunning clutch restrained from axial movement and having an inner race provided with internal splines, a slide output shaft axially movably inserted in the inner race of the overrunning clutch and provided with external splines meshed with the internal splines of the inner race of the overrunning clutch, characterized in that a stopper for limiting the outward movement of the slide output shaft caused by the agency of the thrust of the helical splines of the inner race of the overrunning clutch acting on the outer splines of the slide output shaft when the slide output shaft is rotated by the electric motor is provided on the inner extremity of the slide output shaft disposed in a space formed in the bottom portion of a bottomed central bore formed in the armature shaft.

In operation, the rotative motion of the armature shaft of the electric motor is transmitted through the outer race and rollers of the overrunning clutch to the inner race of the overrunning clutch, and then the slide output shaft is rotated and, at the same time, is thrusted outward by the thrust of the internal helical splines of the inner race of the overrunning clutch acting on the external helical splines of the slide output shaft to engage the pinion fastened to the outer extremity of the slide output shaft and the ring gear of the engine. The outward movement of the slide output shaft is stopped upon the exact engagement of the pinion and the ring gear by the abutment of the stopper provided on the inner extremity of the slide output shaft with the inner end of the inner race of the overrunning clutch.

BRIEF DESCRIPTION OF THE DRAWINGS

The above and other objects, features and advantages of the present invention will become more apparent from the following description taken in conjunction with the accompanying drawings, in which.

DETAILED DESCRIPTION OF THE PREFERRED EMBODIMENT

Figure 1:
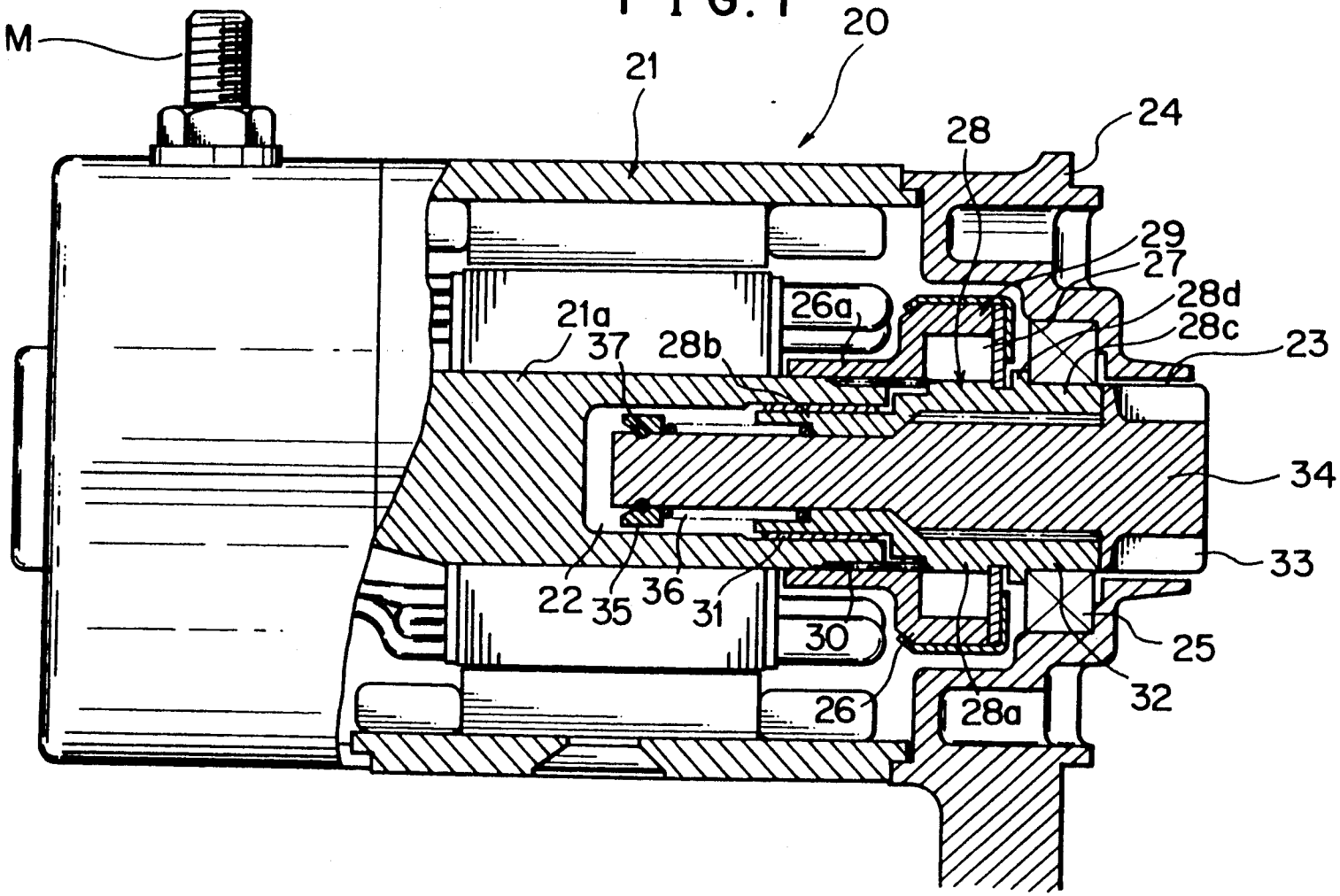
FIG. 1 is a partially sectional view of an inertia drive engine starter in a preferred embodiment according to the present invention.
Figure 2:
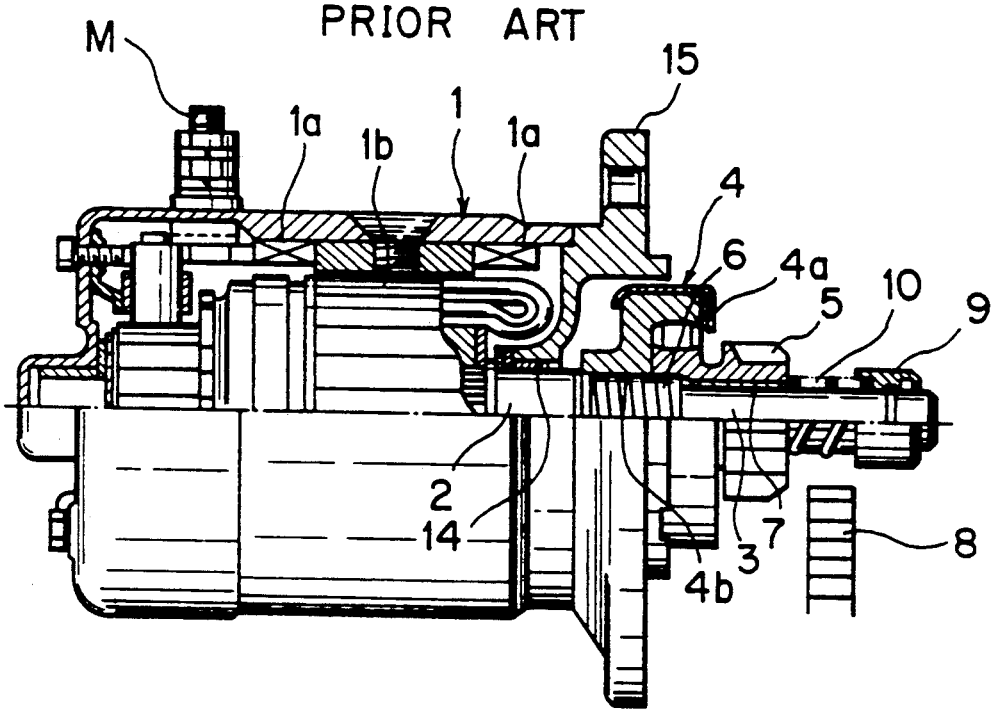
FIG. 2 PRIOR ART
FIG. 2 is a partially sectional view of a conventional inertia drive engine starter.

Referring to FIG. 1, an inertial drive engine starter 20 embodying the present invention has an electric motor 21 provided with a field coil and an armature provided with an armature shaft 21*a* provided with a bottomed central bore 22 in the outer end portion (a right-hand portion as viewed in FIG. 1). The electric motor 21 has a front end plate 24 provided with an opening 23 coaxial with the armature shaft 21*a*. A bearing 25 is fitted in the inner surface of the front end plate 24 coaxially with the armature shaft 21*a*. An overrunning clutch 29 is disposed within the front end plate 24. The overrunning clutch 29 comprises an outer race 26 having a boss 26*a*, an inner race 28*a* and rollers 27 for transmitting the rotative motion of the outer race 26 to the inner race 28*a*. The boss 26*a* of the outer race 26 is provided with internal straight splines engaged with external straight splines 30 formed in the outer end of the armature shaft 21*a*. A first support sleeve 28*b* formed integrally with the inner race 28*a* extends to the rear (to the left as viewed in FIG. 1) coaxially with the boss 26*a* of the outer race 26 into the bottomed central bore 22 of the armature shaft 21*a* through a sleeve bearing 31 fitted in the bottomed central bore 22 to support the rear portion of the inner race 28*a* on the armature shaft 21*a*. A second support sleeve 28*c* formed integrally with the inner race 28*a* extends to the front (to the right as viewed in FIG. 1) and is supported in the bearing 25 fitted in the front end plate 24. A circular flange 28*d* is formed on the outer surface of the second support sleeve 28*c* so as to be in contact with the inner end of the inner race of the bearing 25 when the overrunning clutch 29 is disposed in place. The overrunning clutch 29 is restrained from axial movement in either direction relative to the armature shaft 21*a* by the engagement of the circular flange 28*d* of the second support sleeve 28*c* and inner end of the inner race of the bearing 25, and from the engagement of the rear end of the internal straight splines of the outer race 26 and that of the outer straight splines of the armature shaft 21*a*.

Internal helical splines 32 are formed in the continuous inner circumferences of the inner race 28*a* of the overrunning clutch 29 and the second support sleeve 28*c* formed integrally with the inner race 28*a*. A slide output shaft 34 with an integral pinion 33 formed on the front end thereof is axially slidably inserted in a tubular member 28 consisting of the inner race 28*a* of the overrunning clutch 29, the first support sleeve 28*b* formed integrally with and extended rearward from the rear end of the inner race 28*a* and the second support sleeve 28*c* formed integrally with and extended from the front end of the inner race 28*a*. The rear end of the slide output shaft 34 is received in the bottomed central bore 22 of the armature shaft 21*a*. The slide output shaft 34 is provided with external helical splines, which engage the internal helical splines 32 of the tubular member 28. The inner race 28*a* of the overrunning clutch 29 drives the slide output shaft 34 for simultaneous rotation and forward axial movement by the thrust of the internal helical splines 32 formed on the inner race 28*a* and the second support sleeve 28*c* acting on the external helical splines of the slide output shaft 34. The slide output shaft 34 is in sliding engagement with the inner surface of the first support sleeve 28*b* of the tubular member 28 and the bottom surfaces of helical grooves between the internal helical splines 32.

A stopper 35 is attached to the rear end of the slide output shaft 34 received in the bottomed central bore 22 of the armature shaft 21*a*. A return spring 36 is extended between the stopper 35 and a shoulder formed in a bore formed in the rear extremity of the first support sleeve 28*b*. The rearward movement of the stopper 35 is limited by a stop ring 37 attached to the rear end of the slide output shaft 34.

Figure 3:
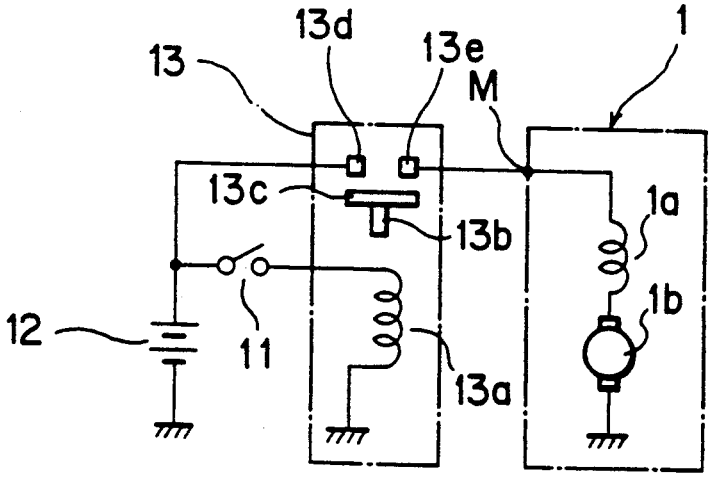
FIG. 3 PRIOR ART
FIG. 3 is a circuit diagram of an engine starting circuit including the electric motor of the inertia drive engine starter of FIG. 2.

A circuit connected to the feed terminal M of the inertia drive engine starter is the same in function as that employed in the foregoing known inertia drive engine starter of FIG. 3, and hence the description thereof will be omitted.

In operation, upon the application of a voltage to the feed terminal M by the battery 12, currents are supplied to the field coil and armature coil of the electric motor 21 and the armature shaft 21*a* starts rotating. The rotative motion of the armature shaft 21*a* is transmitted through the external straight splines 30 of the armature shaft 21*a*, the internal straight splines formed in the boss 26*a* of the outer race 26 and the rollers 27 to the inner race 28*a*. Then, the thrust of the internal helical splines 32 of the inner race 28*a* and the inertia of the slide output shaft 34 move the slide output shaft 34 to the front against the resilience of the return spring 36 while torque transmitted to the inner race 28*a* rotates the slide output shaft 34 and, consequently, the pinion 33 disposed within the opening 23 is moved to the front and is caused to engage the ring gear of the engine to start the engine.

When the slide output shaft 34 arrives at a fully advanced position, where the pinion 33 and the ring gear of the engine is in perfect engagement, the stopper 35 comes into abutment with the rear end of the first support sleeve 28*b* of the tubular member 28 to stop the further advancement of the slide output shaft 34. Since the flanges 28*d* formed on the second support sleeve 28*c* of the tubular member 28 is in abutment with the inner end of the bearing 25, the tubular member 28 is unable to move axially to the front.

After the engine has been started, the starter switch is turned off. Then, the slide output shaft 34 is pushed back by the resilience of the return spring 36 to its initial position as shown in FIG. 1.

Since the pinion 33 is provided on the front end of the axially movable slide output shaft 34, and all the components of the inertia drive engine starter 20 including the stopper 35 are disposed behind the pinion 33, the pinion 33 is the foremost member of the inertia drive engine starter 20. Since the pinion 33 is stored within the opening 23 of the front end plate 24 while the inertia drive engine starter 20 is inoperative, the inertia drive engine starter can very easily be mounted on the engine without interfering with the ring gear and damaging the ring gear, and the inertia drive engine starter places no restriction on the layout of the components of the engine. As stated above, only the pinion is disposed on the front side of the inertia drive engine starter 20, and most portion of the pinion 33 is encased in the opening 23 of the front end plate 24 with a small gap between the pinion 33 and the front end plate 24. Therefore, the inertia drive engine starter 20 hardly lets in water and dust, so that the malfunction of the inertia drive engine starter 20 attributable to the corrosion of the component parts or unsmooth relative sliding movement of the component parts is obviated.

The armature shaft 21*a* and the boss 26*a* of the outer race 26 of the overrunning clutch 29 may be interlocked by any suitable interlocking means, such as forced fit, key interlocking, screw interlocking or a combination of these means, instead of the straight splines, provided that the interlocking means is capable of transmitting the torque of the armature shaft 21*a* to the outer race 26 of the overrunning clutch 29. The armature shaft 21*a* provided with the bottomed central bore 22 in the front end thereof may be substituted by a hollow shaft. Although the stopper 35 is held at the rear end of the slide output shaft 34 by the stop ring 37 in this embodiment, there is no particular restriction on the shape of the stopper 35 and manner of holding the stopper 35 at the rear end of the slide output shaft 34. The pinion 33 need not necessarily be formed integrally with the slide output shaft 34, a pinion formed separately may be attached to the front end of a slide output shaft corresponding to the slide output shaft 34.

As is apparent from the foregoing description, the inertia drive engine starter of the present invention has, at its front end, no component which may possibly interfere with the engine other than the pinion to be brought into engagement with the ring gear of the engine. Accordingly, the inertia drive engine starter can very easily be mounted on the engine without interfering the ring gear and without damaging the ring gear and does not place any restriction on the design of the layout of the components of the engine.

Although the invention has been described in its preferred form with a certain degree of particularity, obviously many changes and variations are possible therein. It is therefore to be understood that the present invention may be practice otherwise than specifically described herein without departing the scope and spirit thereof.

What is claimed is:

1. An inertial drive engine starter comprising:

an electric motor having an armature shaft provided with a bottomed central bore in a front end of said armature shaft;

an overrunning clutch comprising an outer race driven for rotation by the armature shaft, rollers, and an inner race driven for rotation through the rollers by the outer race and provided with internal helical splines in the inner surface thereof, said outer race including a radially inward boss splined to and driven by said armature shaft;

a slidable output shaft axially movably supported in the inner race of the overrunning clutch with one end received in the bottomed central bore of the armature shaft, provided with a pinion at an oppositely extending other end thereof, and provided with external helical splines formed in an outer surface thereof and engaging the internal helical splines of said inner race so that the slidable output shaft is rotated together with the inner race of the overrunning clutch; and a stopper attached to the extremity of the one end of the slidable output shaft received in the bottomed central bore of the armature shaft to limit the outward axial movement of the slidable output shaft.

said inner race of the overrunning clutch being restrained from axial movement by a bearing which directly contacts a front end plate of said starter, wherein said stopper abuts the inner race of the overrunning clutch to limit the outward axial movement of the slidable output shaft to a predetermined fully advanced position when the slidable output shaft is rotated and moved axially outward by its inertia and the thrust of the internal helical splines of the inner race acting on the external helical splines of the slidable output shaft.

2. An inertia drive engine starter according to claim 1, wherein said boss of said outer race of the overrunning clutch is provided with internal straight splines in the inner surface thereof, and external straight splines mating with the internal straight splines of the boss of the outer race are formed in a free end of the armature shaft, so that the torque of the armature shaft is transmitted through the external straight splines of the armature shaft and the internal straight splines of the boss of the outer race in engagement with the external straight splines of the armature shaft to rotate the outer race of the overrunning clutch.

3. An inertia drive engine starter according to claim 1, wherein the bottomed central bore of the armature shaft opens toward the front.

4. An inertia drive engine starter according to claim 1, wherein, a major portion of said pinion is received in an opening formed in said front end plate of said starter with a small gap between the pinion and the front end plate.

5. An inertia drive engine starter according to claim 1, wherein a return spring is extended between said stopper and the inner race of said overrunning clutch to return the output shaft automatically to its initial position when said electric motor is disconnected from a power supply.

6. An inertia drive engine starter according to claim 1, wherein said inner race includes a support sleeve on one end and a flange on another end thereof, such that said support sleeve contacts said stopper and transfers thrust from the stopper directly to said flange, said flange transferring said thrust to said bearing and said front end plate.

* * * * *